US006880646B2

(12) United States Patent
Batarseh

(10) Patent No.: US 6,880,646 B2
(45) Date of Patent: Apr. 19, 2005

(54) LASER WELLBORE COMPLETION APPARATUS AND METHOD

(75) Inventor: Samih Batarseh, Mount Prospect, IL (US)

(73) Assignee: Gas Technology Institute, Des Plaines, IL (US)

( * ) Notice: Subject to any disclaimer, the term of this patent is extended or adjusted under 35 U.S.C. 154(b) by 25 days.

(21) Appl. No.: 10/417,003

(22) Filed: Apr. 16, 2003

(65) Prior Publication Data

US 2004/0206505 A1 Oct. 21, 2004

(51) Int. Cl.[7] ..... E21B 43/26; E21B 36/00; E21B 29/02; B23K 26/08

(52) U.S. Cl. ..... 175/15; 166/55.1; 166/57; 166/222; 166/298; 166/308.1; 175/12; 219/121.66; 219/121.67; 219/121.79

(58) Field of Search ..... 219/121.8, 121.85, 219/121.6, 121.65, 121.66, 121.67, 121.78, 121.79; 166/308, 305.1, 308.1, 279, 297, 55, 298, 55.1, 55.6, 55.7, 57, 65.1, 222; 175/11, 12, 15, 57

(56) References Cited

U.S. PATENT DOCUMENTS 3,297,876 A * 1/1967 De Maria ..... 359/286
3,461,964 A * 8/1969 Venghiattis ..... 166/297
3,493,060 A * 2/1970 Van Dyk ..... 175/16
3,871,485 A 3/1975 Keenan, Jr.
3,977,478 A * 8/1976 Shuck ..... 175/16
4,061,190 A * 12/1977 Bloomfield ..... 166/259
4,066,138 A 1/1978 Salisbury et al.
4,090,572 A 5/1978 Welch
4,113,036 A 9/1978 Stout
4,199,034 A * 4/1980 Salisbury et al. ..... 175/11
4,227,582 A * 10/1980 Price ..... 175/16
4,282,940 A 8/1981 Salisbury et al.
4,544,034 A * 10/1985 George ..... 166/297
4,573,537 A * 3/1986 Hirasuna et al. ..... 166/387
4,776,394 A * 10/1988 Lynde et al. ..... 166/55.8
5,107,936 A 4/1992 Foppe
6,012,525 A * 1/2000 Burleson et al. ..... 166/297
6,426,479 B1 * 7/2002 Bischof ..... 219/121.67
6,658,981 B1 * 12/2003 Rochen et al. ..... 89/1.15
6,679,328 B1 * 1/2004 Davis et al. ..... 166/298
6,755,262 B1 * 6/2004 Parker ..... 175/57
2002/0060072 A1 * 5/2002 Cong ..... 166/297

FOREIGN PATENT DOCUMENTS

CA 852000 A * 5/1968

* cited by examiner

*Primary Examiner*—David Bagnell
*Assistant Examiner*—Jennifer H Gay
(74) *Attorney, Agent, or Firm*—Mark E. Fejer

(57) ABSTRACT

A method and apparatus for providing fluid flow into a wellbore in which an apparatus having at least one laser energy output is lowered into the wellbore and the at least one laser energy output is directed at a wall of the wellbore. At least a portion of the wall is heated using the at least one laser energy output, whereby flow of a fluid into the wellbore is initiated and/or- enhanced.

10 Claims, 2 Drawing Sheets

LASER WELLBORE COMPLETION APPARATUS AND METHOD

BACKGROUND OF THE INVENTION

1. Field of the Invention

This invention relates to a method and apparatus for completion of oil, gas and/or hydrothermal wells. More particularly, this invention relates to the application of laser energy for initiating or promoting the flow of a desired resource, e.g. oil, into a wellbore, referred to herein as well completion.

2. Description of Related Art

Once the drilling of a well has been completed, fluid flow into the well is initiated by perforation of the well casing or liner. Such perforations are created using bullets or shaped charges for establishing flow of oil or gas from the geologic formations into the wellbore. The perforations typically extend a few inches into the formation. However, there are numerous problems with this approach. First, the melt from shaped charges or debris from the bullet impact usually reduces the permeability of the producing formations resulting in a substantial reduction in production rate. Second, these techniques involve the transportation and handling of high power explosives and are causes of serious safety and security concerns. Third, the impact of the bullet into the formation also produces fine grains that can plug the pore throat, thereby reducing the production rate.

Additionally, other steps for initiating fluid flow may also be required, depending, at least in part, on the physical properties of the fluid in question and the characteristics of the rock formation surrounding the well. Fluid flow may be inhibited in situations involving highly viscous fluids and/or low permeability formations. Highly viscous fluids do not flow easily. As a result of the decreased rate of flow, efficiency is lowered and overall production rate decreases. The same is true for low permeability formations. In extreme cases, these factors reduce the flow rate to zero, halting production entirely.

One conventional approach to addressing the problem of fluid flow is in situ combustion in which oxygen is injected down hole and burned to induce heating effects. However, the effectiveness of burning oxygen is dependent upon the type of rock in the rock formation. In addition, the technique of burning oxygen affects only the area of initial contact.

SUMMARY OF THE INVENTION

Accordingly, it is one object of this invention to provide a method and apparatus for initiating fluid flow into a well bore.

It is one object of this invention to provide a method and apparatus for reducing the viscosity of highly viscous fluids so as to increase the flow rate of fluids contained within the rock formations surrounding a well.

It is yet another object of this invention to provide a method and apparatus for perforating the well casing of a wellbore which provides a clean and extended tunnel for the fluid to flow into the well.

It is still a further object of this invention to provide a method and apparatus for perforating the well casing of a wellbore which eliminates safety and security risks.

It is yet a further object of this invention to provide a method and apparatus for perforating the well casing of a wellbore which eliminates the damage to formations which reduces fluid production arising from the use of conventional perforation techniques.

It is another object of this invention to provide a method and apparatus for perforating the well casing of a wellbore which results in the formation of a long and clean flow path between the fluid reservoir and the wellbore.

It is still a further object of this invention to provide a method and apparatus for perforating the well casing of a wellbore which provides the ability to cut precise openings through the casing.

These and other objects of this invention are addressed by an apparatus comprising a housing having a front portion and a back portion, at least one light energy source disposed within the housing suitable for emitting at least one laser beam suitable for melting and/or vaporizing a well casing, cement and/or rock formations encountered in a wellbore and directing means for directing the at least one laser beam onto a wall of the wellbore. In accordance with a particularly preferred embodiment, the housing is transparent, made of any material suitable for downhole conditions through which a laser beam can be transmitted, for example glass or sapphire. In accordance with an alternative embodiment, the housing is made of a combination of transparent and non-transparent materials, for example, a steel housing comprising transparent windows. The apparatus of this invention can be used down hole to deliver laser energy to the rock formations. The apparatus can accept as its inputs one or more laser beams delivered either via fiber optic cable or a physical down-hole laser. The laser beam, which is projectable onto the wall of the wellbore, is of variable power depending upon the method employed for initiating or enhancing fluid flow into the wellbore. In those cases where the objective is merely to reduce the viscosity of the fluid disposed within the rock formations, a relatively lower amount of laser energy is required than in those cases where it is desired to perforate the wellbore wall and tunnel into the surrounding formation. In addition, in those cases where the objective is merely to reduce the viscosity of the fluid disposed within the rock formations, a relatively broad beam may be employed. In contrast thereto, for situations in which the objective is perforation of the wellbore, relatively narrow, highly focused laser beams are preferred. The laser beams may also be used to introduce macro and micro fractures in the rock formations surrounding the wellbore. This is particularly effective in cases where low permeability formations are encountered. Experimentation has shown that exposure to high power laser beams induces structural decomposition in very strong rock formations, such as granite. The resultant fracture increases permeability significantly, thereby increasing the fluid flow through the formation and into the wellbore.

Depending upon the desired effect, either a continuous wave laser or a pulsed or chopped laser may be employed. Continuous wave lasers are particularly suitable for providing constant heat energy for the purpose of reducing the viscosity of highly viscous fluids. In contrast thereto, the use of a pulsed wave or chopped beam produces rapid blasts of intense heat energy followed by periods of cooling, which is particularly suitable for inducing high stresses within the rock formation. Once the fluid has been heated and the formation fractured, by controlling the pressure in the well, an under balance or an over balance can be established. Under balance can be used in production wells to draw fluids inwards while over balance can be used to push the fluids outward, typically in the direction of an adjacent production well. The combined manipulation of well pressure by conventional means and of formations/fluids by lasers in accordance with the method of this invention results in a more efficient process.

In accordance with one embodiment of this invention, the laser energy may be employed for perforating the wellbore, which typically will involve melting or vaporizing the well casing, cement and/or rock formation present in the wellbore. In accordance with this embodiment, the apparatus comprises a number of lenses and reflectors capable of redirecting the laser beam(s) onto the wellbore wall at independent or convergent heights and angles. The apparatus is suitable for use in any well including deep wells where high pressures and temperatures are present. After the apparatus is lowered down into the wellbore and fixed in place, the beam(s) in use are focused and reflected onto the well casing, cement and finally the target. For different perforation zones, the apparatus can be oriented and positioned at specific targets to perforate the formation in question. To create several tunnels, a plurality of laser beams may be projected at different heights and angles. To create one deep hole, all the beams can be focused on one spot by use of freely rotatable mirrors. To create a hole larger than the laser beam size, one single mirror capable of rotating in a spiral motion may be used to create a hole with controlled shape and size. The freely rotatable mirrors can also direct the beam in a systematic manner to cut openings of different sizes and shapes in the well casing for different purposes.

BRIEF DESCRIPTION OF THE DRAWINGS

These and other objects and features of this invention will be better understood from the following detailed description taken in conjunction with the drawings wherein.

DETAILED DESCRIPTION OF THE PRESENTLY PREFERRED EMBODIMENTS

Figure 1:
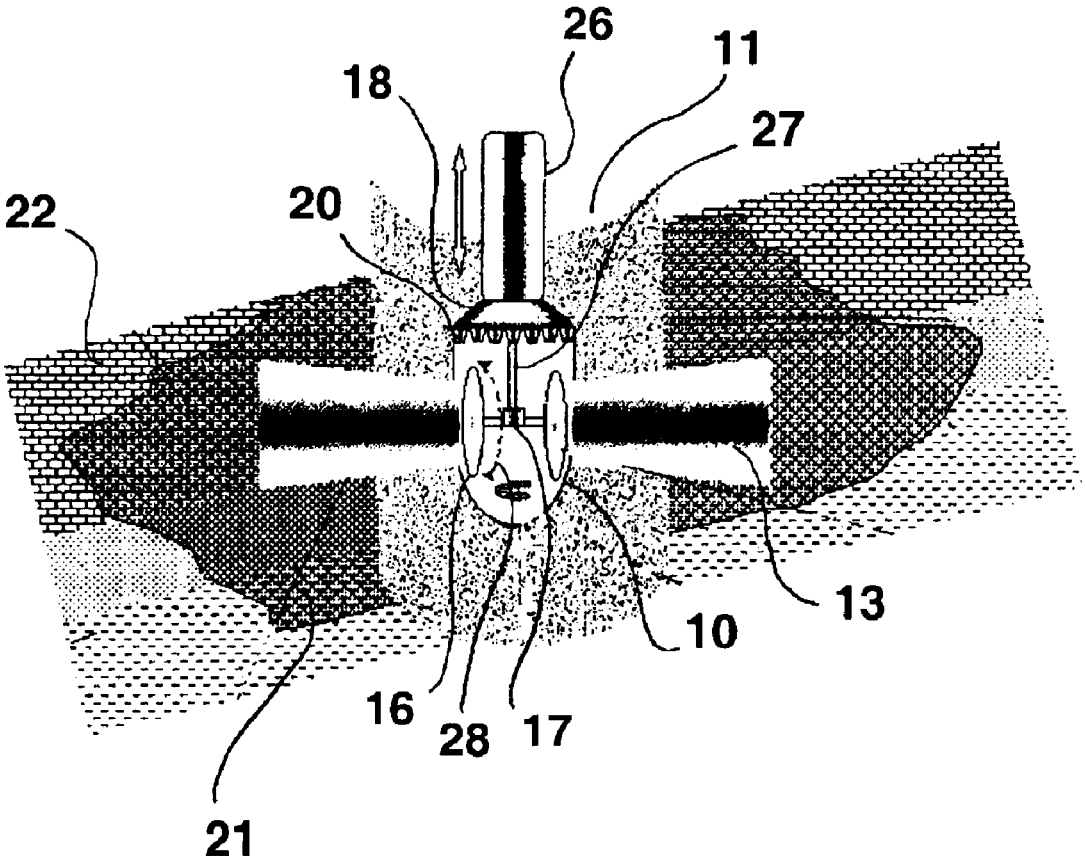
FIG. 1 is an illustration showing a simplified lateral view of an apparatus in accordance with one embodiment of this invention, which is particularly suitable for use in connection with fluid heating and formation fracturing.

A laser well completion apparatus in accordance with one embodiment of this invention is shown in FIG. 1. The apparatus, shown disposed within a wellbore 11 surrounded by areas of highly viscous fluids 21, which, in turn, are disposed within a rock formation 22, comprises a housing 10, which in accordance with a particularly preferred embodiment of this invention is a transparent housing typically formed of a glass or sapphire material. Disposed within transparent housing 10 is a laser energy source 27 suitable for emitting at least one laser beam. In accordance with one preferred embodiment, laser energy source 27 comprises at least one optical fiber having a laser beam output end disposed within transparent housing 10 and a laser energy input end operably connected to a laser energy generator (not shown). Also disposed within transparent housing 10 is at least one laser beam directing means 16. In accordance with one embodiment of this invention, laser beam directing means 16 is in the form of a lens. As indicated by arrows 28, lenses 16 are adjustable to enable precise focusing and direction of the laser beams 13 at different heights and angles along the wall of wellbore 11.

In accordance with one embodiment of this invention, the apparatus comprises at least two lenses 16, whereby the laser beams 13 are projected onto the wellbore wall in opposite directions. Lenses 16 and laser source 27 are operably connected to a motor 17, power for which may be provided through power cable 26. Motor 17 enables rotation of lenses 16 about a point disposed between said lenses 16 so as to enable sweeping of the laser beams 13 in a full circular plane. In accordance with one embodiment of this invention, transparent housing 10 is operably connected to a motor 18 disposed proximate the back portion thereof to enable rotation not only of the lenses 16 disposed within transparent housing 10, but also transparent housing 10 itself. In addition, transparent housing 10 and all of the elements contained therein can be raised or lowered within wellbore 11 to further increase the surface area of the wellbore wall reachable by the laser beams 13. In accordance with one embodiment of this invention, purging nozzles 20 are provided to remove dust or other particles from transparent housing 10. Suitable purging fluids may be gas, such as high pressure air, or liquids.

In some instances, purging nozzles 20 may not be able to remove all of the dust or other particles from the transparent housing 10, which, in turn, may prevent the laser beams 13 from passing through transparent housing 10 and onto the wellbore wall. In accordance with one embodiment of this invention, transparent housing 10 forms at least one opening 132 as shown, for example, in FIG. 2 through which laser beams 113 may be directed onto the wellbore wall. It will be apparent to those skilled in the art that, for embodiments such as this, transparency of housing 10 is no longer required. Thus, housing 10 may be formed of any non-transparent material suitable for use down hole.

The embodiment of the apparatus of this invention shown in FIG. 1 is particularly suitable for expediting fluid flow from the areas of highly viscous fluids 21 disposed within rock formation 22 surrounding wellbore 11 by reducing the viscosity of the fluid and/or through the introduction of macro and micro fractures within the rock formation 22. Reduction of fluid viscosity is achieved by directing the laser beams 13 onto the wellbore wall so as to heat the fluid disposed in the rock formation surrounding the wellbore. By sweeping the laser beams around the rock surface, heating can be made to occur uniformly around the wall or in specific areas. Preferably, a continuous wave laser is employed so as to provide constant heat energy.

Experiments have shown that exposure of the rock formation 22 to laser beams induces fracturing of the rock formation sufficiently enough to enable fluid flow in low or zero permeability formations. Specifically, directing of a laser beam onto granite followed by impregnation with blue epoxy, which is used to map and monitor fractures, showed significant fracturing and permeability increases.

Figure 2:
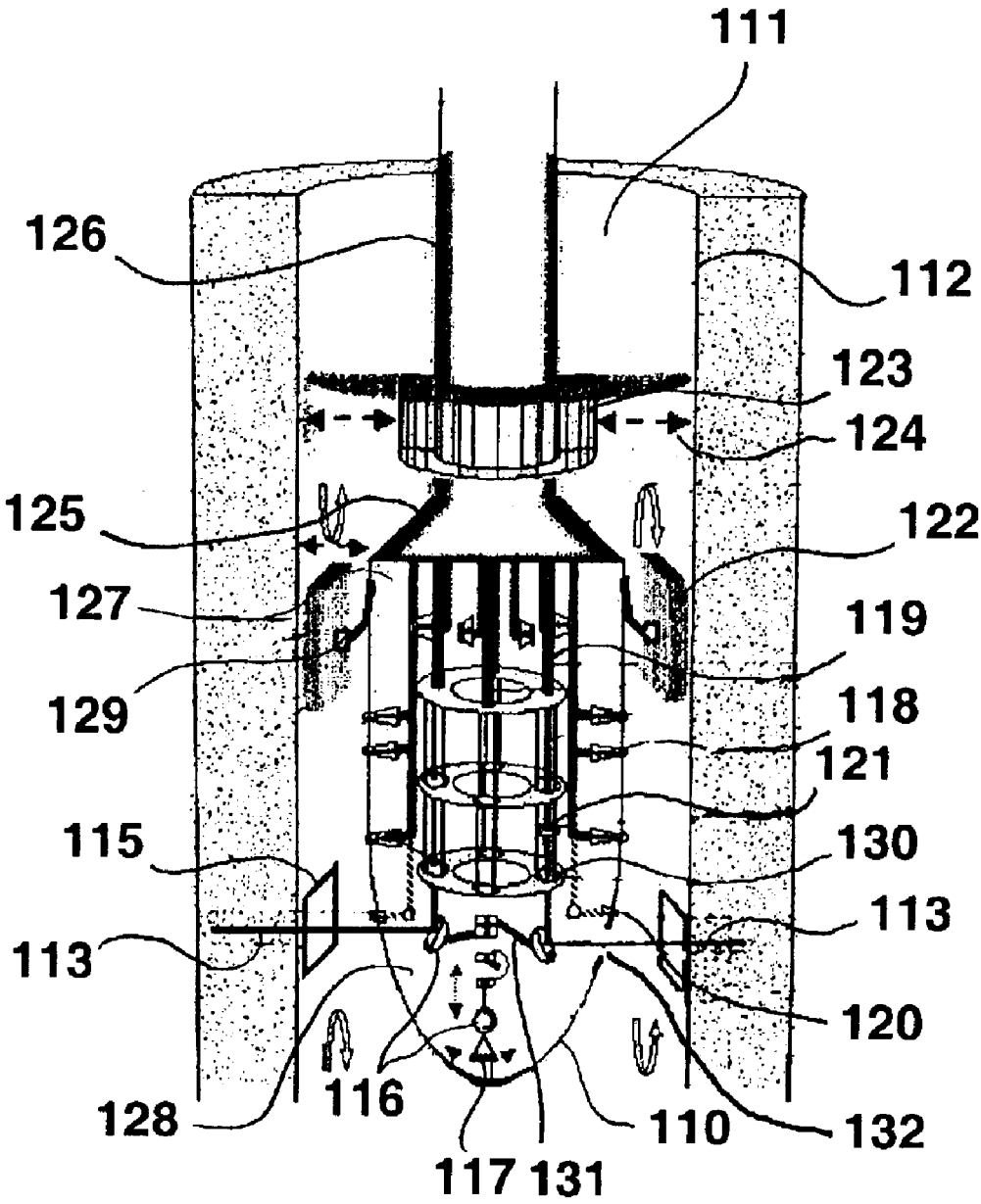
FIG. 2 is an illustration showing a lateral view of an apparatus in accordance with another embodiment of this invention, which is particularly suitable for use in connection with well casing perforation and tunneling.

An alternative embodiment of the apparatus of this invention as shown in FIG. 2 is particularly suitable for use in perforating the wellbore wall 112 to establish the flow of oil or gas from the geologic formations disposed around the wellbore. High energy laser beams 113 are used to create holes in the wellbore wall, typically a well casing, and to create a clean and extended tunnel for the fluid to flow into the well. The tunnel size and shape can be controlled very precisely. In addition to extended length compared to conventional techniques, which extended length provides additional surface area for fluids to flow from, the laser-generated heat enhances the permeability of the rock formation adjacent to the tunnel, thereby increasing the flow rate. Compared to conventional technology used to perforate well casings, the apparatus of this invention eliminates safety and security risks, eliminates reservoir damage, significantly enhances production rate through increases in permeability, creates a long and clean flow path and provides the ability to cut clean windows 115 through the well casing.

As shown in the exemplary embodiment of FIG. 2, laser beams 113 are transmitted into transparent housing 110, which is operably connected to motor 125, through fiber optic cables 119 having a laser beam output end disposed within transparent housing 110. Fiber optic cables 119 have a laser energy input end (not shown) operably connected to a laser energy source. In accordance with one embodiment of this invention, fiber optic cables 119 extend through power cables and drawback conduit 126 to a laser energy source disposed above ground. Alternatively, the laser energy source may be disposed down hole proximate to the well completion system.

Having been transmitted into transparent housing 110, each laser beam 113 passes through a collimator lens 121 and a focusing lens 130 before striking a reflector 116, which, in accordance with one embodiment of this invention is a mirror. The focusing lens 130 is movably mounted within transparent housing 110 to enable precise altering of the laser beam size. Where multiple laser beams 113 and multiple focusing lenses 130 are employed, the focusing lenses may be movably mounted so as to be movable together, thereby enabling uniformity in laser beam sizes. Alternatively, the focusing lenses 130 are independently movably mounted to enable independent control over the beam size of each laser beam. Having passed through lenses 121 and 130, thereby fixing the beam size, laser beam 113 strikes a reflector 116. Reflector 116 is mounted on an arm system 131 which provides vertical mobility for each such reflector. As a result, in addition to being independently sizable, each beam is independently vertically adjustable to enable disposition of each laser beam at a distinct height within wellbore 111. Reflectors 116 are also suitably adjustable to enable control of the angle of incidence between the laser beam and the wellbore wall. For example, reflectors 113 are able to be vertically tilted, thereby enabling directing of the laser beam upwards or downwards. Reflectors 113 are also able to be horizontally rotated, thereby enabling directing of the laser beam left or right. In accordance with one embodiment of this invention, a crystal reflector 117 is disposed in the front section 128 of transparent housing 110, which crystal reflector may be used to split a single laser beam traveling in one direction into a plurality of laser beams directed in multiple directions.

As shown in FIG. 2, the apparatus in accordance with one embodiment of this invention comprises at least one vacuum nozzle 118 disposed upstream of lenses 121 sealably disposed within and extending through an opening formed by transparent housing 110. As used herein, the term "upstream" when used in connection with the relative disposition of elements refers to a direction closer to the earth's surface. Each vacuum nozzle 118 is operably connected to a vacuum pump (not shown), which may be disposed down hole or above ground. Vacuum nozzles 118 remove potentially dangerous gases from the completion area released by the vaporization of rock. To prevent the escape of any such potentially dangerous gases from wellbore 111, the apparatus further comprises a laterally expandable seal means proximate the back section 127 of transparent housing 110. In accordance with one embodiment of this invention, said expandable seal means comprises an expandable bellows 123 disposed upstream of vacuum nozzles 118, which expandable bellows are expandable in the direction indicated by arrow 124 to form a seal with the wellbore wall, thereby ensuring that any products resulting from the vaporization, decomposition and/or dehydration of the rock during the completion operation does not escape from the hole.

In accordance with one preferred embodiment, at least one purging nozzle 120 is disposed within transparent housing 110 downstream of vacuum nozzles 118. Each said purging nozzle has a purging fluid outlet end sealably disposed within and extending through a purge opening formed by transparent housing 110. Each said purging nozzle 120 is connected to a purging fluid supply (not shown).

In accordance with one embodiment of this invention, the apparatus comprises a plurality of centering and stabilizing means for maintaining the apparatus in a fixed, centered position. As shown in FIG. 2, said centering and stabilizing means comprises a plurality of centering/stabilizing pads 122 operably connected to the exterior surface of transparent housing 110. In accordance with one preferred embodiment of this invention, pads 122 are connected to the exterior surface of transparent housing 110 by retractable arms 129, which enable pads 122 to move outwardly from transparent housing 110 and engage the surface of the wellbore wall.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed is:

1. An apparatus comprising:

a transparent housing having a front portion and a back portion;

at least one light energy source disposed within said transparent housing suitable for emitting at least one laser beam suitable for heating at least one of a well casing, cement and rock formations encountered in a wellbore;

a means for directing said at least one laser beam onto a wall of said wellbore; and a plurality of nozzles disposed within said transparent housing, each of said nozzles disposed within a corresponding opening formed in said transparent housing between said front portion and said back portion.

2. An apparatus in accordance with claim 1, wherein said directing means comprises at least one adjustable reflector suitable for reflecting said at least one laser beam onto said wall of said wellbore.

3. An apparatus in accordance with claim 2, wherein said at least one adjustable reflector is selected from the group consisting of mirrors, crystal reflectors and combinations thereof.

4. An apparatus in accordance with claim 1, wherein said at least one light energy source is an optical fiber having a laser beam output end disposed within said transparent housing and a laser energy input end connected to a laser energy generator.

5. An apparatus in accordance with claim 1, wherein said plurality of nozzles comprise nozzles selected from the group consisting of purge nozzles adapted to deliver a purge fluid into said wellbore, vacuum nozzles adapted to remove at least one gaseous fluid from said wellbore and combinations thereof.

6. An apparatus in accordance with claim 1 further comprising sweeping means for laterally sweeping said at least one laser beam across a periphery of said wellbore.

7. An apparatus in accordance with claim 1 further comprising a means for stabilizing or a means for centering said transparent housing within said wellbore.

8. An apparatus in accordance with claim 7, wherein said stabilizing means or said centering means comprises a plurality of laterally adjustable pads secured to an exterior surface of said transparent housing.

9. An apparatus in accordance with claim 1 further comprising sealing means disposed proximate said back portion of said transparent housing suitable for sealing against said wall of said wellbore.

10. An apparatus in accordance with claim 9, wherein said sealing means comprises an expandable sealing bellows.

* * * * *